US008052766B2

(12) United States Patent
Varner et al.

(10) Patent No.: US 8,052,766 B2
(45) Date of Patent: Nov. 8, 2011

(54) DEVICE AND METHOD FOR CLEANING SELECTIVE CATALYTIC REDUCTION PROTECTIVE DEVICES

(75) Inventors: Michael G. Varner, Knoxville, TN (US); David K. Anderson, East Longmeadow, MA (US)

(73) Assignee: ALSTOM Technology Ltd, Baden (CH)

( * ) Notice: Subject to any disclaimer, the term of this patent is extended or adjusted under 35 U.S.C. 154(b) by 747 days.

(21) Appl. No.: 11/505,169

(22) Filed: Aug. 16, 2006

(65) Prior Publication Data

US 2008/0041417 A1 Feb. 21, 2008

(51) Int. Cl.

| | |
|---|---|
| ***B01D 41/00*** | (2006.01) |
| ***B01D 45/18*** | (2006.01) |
| ***B01D 46/04*** | (2006.01) |
| ***B08B 3/00*** | (2006.01) |
| ***B08B 3/12*** | (2006.01) |
| ***B08B 6/00*** | (2006.01) |

(52) U.S. Cl. ..... 55/300; 134/184

(58) Field of Classification Search ..... 134/113, 134/184, 201; 96/33, 34; 55/300
See application file for complete search history.

(56) References Cited

U.S. PATENT DOCUMENTS

| | | | | |
|---|---|---|---|---|
| 2,198,618 | A | 4/1940 | Horne | |
| 3,427,787 | A * | 2/1969 | Hilge | 96/34 |
| 3,844,742 | A * | 10/1974 | Petersen | 96/35 |
| 3,920,085 | A * | 11/1975 | Bourke | 96/34 |
| 4,035,165 | A * | 7/1977 | Archer | 95/25 |
| 4,093,431 | A * | 6/1978 | Frauenfelder | 96/34 |
| 4,350,504 | A * | 9/1982 | Diachuk | 422/105 |
| 4,502,870 | A * | 3/1985 | Wheeler | 95/2 |
| 4,653,578 | A * | 3/1987 | Horning | 165/84 |
| 4,928,456 | A * | 5/1990 | Del Gatto et al. | 95/74 |
| 5,114,442 | A * | 5/1992 | Artz | 96/19 |
| 5,223,005 | A * | 6/1993 | Avondoglio | 95/280 |
| 5,300,270 | A * | 4/1994 | Krigmont et al. | 423/239.1 |
| 6,548,033 | B2 | 4/2003 | Ganeshan | |
| 6,647,726 | B2 * | 11/2003 | Saviharju et al. | 60/653 |
| 2005/0201914 | A1 * | 9/2005 | Ritzenthaler | 423/230 |

FOREIGN PATENT DOCUMENTS

| | | |
|---|---|---|
| DE | 197 05 663 | 4/1998 |

OTHER PUBLICATIONS

Machine Translation: DE 19705663 A1 to Ranly et al. Apr. 1998.*
PCT International Search Report dated Jan. 22, 2008 (PCT/US2007/071446).
Written Opinion of the International Searching Authority dated Jan. 22, 2008—(PCT/US2007/071446).

* cited by examiner

*Primary Examiner* — Michael Barr
*Assistant Examiner* — Charles W Kling
(74) *Attorney, Agent, or Firm* — Wiggin and Dana LLP; Anthony P. Gangemi

(57) ABSTRACT

One embodiment described herein relates to a system for removing pollutants from a flue gas. The system includes a selective catalytic reduction (SCR) system having a SCR reactor containing a $NO_x$ reducing catalyst and one or more SCR protective devices. At least one of the SCR protective devices is connected to a rapping hammer system that actively remove fly ash collected on the SCR protective devices.

9 Claims, 5 Drawing Sheets

DEVICE AND METHOD FOR CLEANING SELECTIVE CATALYTIC REDUCTION PROTECTIVE DEVICES

BACKGROUND OF THE INVENTION

1. Field of the Invention

This invention relates to a device and method of cleaning protective screens used in a Selective Catalytic Reduction (SCR) system.

2. Description of the Related Art

Selective Catalytic Reduction (SCR) systems are increasingly being applied to coal-fired power stations to reduce nitrogen oxide ($NO_x$) emissions. SCR systems commonly include a SCR reactor that contains a $NO_x$ reducing catalyst that converts $NO_x$ present in flue gases emitted from a combustion source into by-products of nitrogen and water. Many power station installations place the SCR reactor system in a "high dust" location between the combustion source and a particle collection system. Generally, these installations have ductwork that directs or diverts the particle-laden flue gases from the combustion source to the SCR reactor system and then to an air preheater.

The dust loading ability of these SCR systems, located in such "high dust" locations, is an important consideration in their design and use. In particular, the $NO_x$ reducing catalyst composition and construction thereof should be designed to withstand erosion and potential chemical degrading effects of the fly ash and other particles in the flue gases. Similarly, the ductwork to and from the SCR reactor system and the associated internal structures within the SCR system should be designed to withstand this erosive environment. For example, certain aspects of the ductwork design parameters, such as the duct's gas velocity, may be closely monitored to insure proper operation. In particular, undesirable operating results such as unwanted fly ash drop out should be prevented or minimized by selection of proper operating design parameters.

The $NO_x$ reducing catalyst construction in the SCR reactor also requires proper design considerations. Generally, the $NO_x$ reducing catalyst is constructed in a manner that has gas channels whereby the flue gases can pass through such channels to maximize contact with the catalyst surface thereby maximizing the reduction of $NO_x$. The gas channels of the $NO_x$ reducing catalyst typically have a diameter in the range of about 5 to 7 mm. However, particles in the flue gas (hereinafter referred to as "fly ash") generally have a wide range of sizes (e.g. from 1-2 microns up to 7 mm and larger).

The larger particles of fly ash, sometimes referred to as "popcorn ash" or large particle ash ("LPA"), may pose problems with the $NO_x$ reducing catalyst. For instance, when the gas channel diameter is 5-7 mm and the fly ash particles are larger than 7 mm, the large fly ash particles may lodge within the channels and block the flow of flue gas through the catalyst. Even fly ash particles smaller than 7 mm have been shown to plug the catalyst channels because of the irregular shape of those particles. If just one irregular shaped fly ash particle gets lodged in the catalyst channels, other fly ash particles cannot pass through the channel, thereby blocking the channel.

This blockage decreases the overall $NO_x$ reduction capability of the system because once a gas channel is blocked, that reaction channel in the $NO_x$ reducing catalyst becomes ineffective. Once many reaction channels become blocked, fly ash accumulation on the $NO_x$ reducing catalyst surface increases rapidly. Over time, the surface of the $NO_x$ reducing catalyst can eventually become so covered with fly ash that the SCR system cannot meet its $NO_x$ reduction target. Also, the resulting increase in catalyst pressure drop will require the system to be cleaned. For SCR units without a gas bypass capability, this build-up may require the combustion source to be shut down as well.

A known practice to mitigate this ash or dust build-up over the $NO_x$ reducing catalyst has been to place one or more mesh screens over the $NO_x$ reducing catalyst. The openings in the mesh screens are selected to be slightly smaller than the diameters of the channels in the $NO_x$ reducing catalyst. Thus, large fly ash particles are stopped from entering the channels in the $NO_x$ reducing catalyst. While this method can keep the actual catalyst channels clean, its ability to lengthen the time between outages for cleaning is uncertain. Cleaning is still necessary for this method because the quantity of large fly ash particles entering the SCR reactor remains unchanged and these fly ash particles are now collected on the screens instead of on the catalyst or within its channels. Large fly ash particles may accumulate on the screens, thereby creating blockages which will then start collecting smaller fly ash particles. It is therefore possible to have mounds of fly ash on each screen.

Mounds of fly ash that are collected on the screens can significantly increase the pressure drop across the SCR system and may lead to localized areas of high velocity, which have been known to cause erosion within the catalyst. The accumulation of fly ash on the screens will also affect gas distribution and gas velocity into the $NO_x$ reducing catalyst. This in turn will reduce the efficiency of the SCR system.

BRIEF SUMMARY OF THE INVENTION

One aspect of the invention relates to a system for removing pollutants from a flue gas. The system includes a selective catalytic reduction (SCR) system that has a SCR reactor containing a $NO_x$ reducing catalyst and one or more SCR protective devices located upstream of the SCR reactor wherein the one or more SCR protective devices substantially prevent large particles in the flue gas from entering the SCR reactor or otherwise impeding the flow of flue gas therethrough. The system also includes a mechanical rapping system for impacting the SCR protective device to dislodge therefrom accumulated large particles.

Another aspect of the invention relates to a method of removing accumulated fly ash from an SCR protective device. The method includes the steps of connecting a rapping hammer system that has at least one hammer and at least one rotating shaft to an SCR protective device, rotating the rotating shaft to turn the at least one hammers, and contacting the at least one hammer to the SCR protective device, whereby accumulated fly ash present on the SCR protective device is removed.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

For the purposes of illustrating the invention, the drawings show a form of the invention that is presently preferred. However, it should be understood that the present invention is not limited to the precise arrangements and instrumentalities shown in the drawings, wherein.

Like reference numbers and designations in the various drawings indicate like elements.

DETAILED DESCRIPTION OF THE INVENTION

The term "SCR protective device" as used in the present specification and claims refers to any device that prevents appreciable quantities of large fly ash particles (LPA) and other large particulate material in flue gases from entering the $NO_x$ reducing catalyst channels or accumulating on other SCR catalyst surfaces. One example of an SCR protective device is a wire mesh screen that has openings that are slightly smaller than the diameters of the $NO_x$ reducing catalyst channels. Typically, the SCR protective device is a screen that is surrounded by a supporting frame.

It is noted that while the SCR protective device prevents appreciable quantities of fly ash from entering the $NO_x$ reducing catalyst channels, it does not hinder the flow of the gas from entering the $NO_x$ reducing catalyst.

Figure 1:
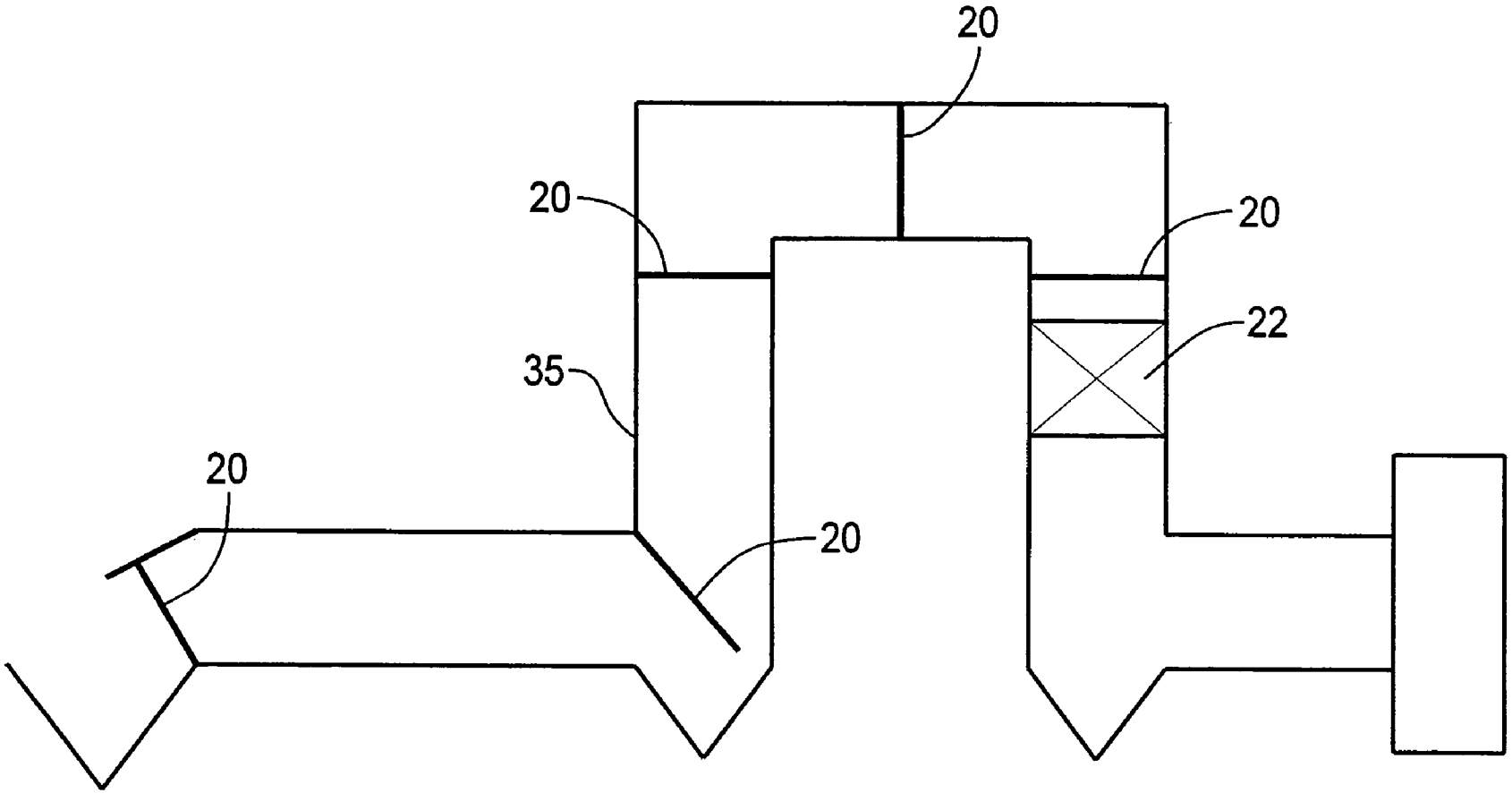
FIG. 1 shows SCR protective devices placed at various points in ductwork upstream of the SCR reactor.

Now referring to the figures in which like numerals correspond to like parts, and in particular to FIG. 1, an SCR protective device 20 may be placed in various locations upstream of the SCR reactor 22. One embodiment described herein relates to the active removal of accumulated fly ash on any SCR protective device 20 placed upstream of SCR reactor 22 as well as any SCR protective device that is placed directly over the catalyst material. In one embodiment, SCR protective device 20 can be placed in a sloped or angled orientation in relation to a flue duct wall ("ductwork") 35. In another embodiment, SCR protective device 20 can be placed in a perpendicular orientation in relation to flue duct wall 35.

Figure 2:
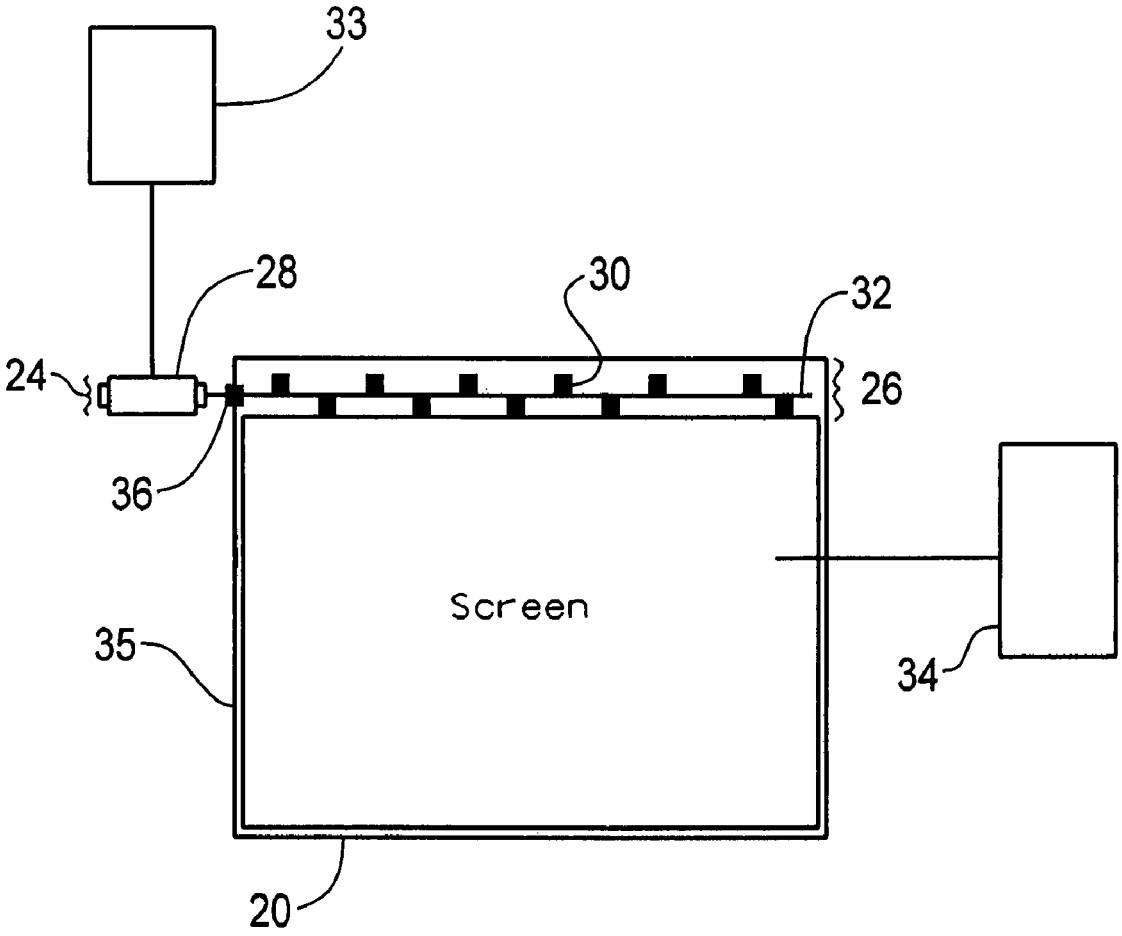
FIG. 2 shows a rapping hammer assembly within a flue gas stream.

As shown in FIG. 2, one embodiment of the invention has a mechanical rapping system 24 operatively connected to SCR protective device 20. Mechanical rapping system 24 generally includes a rapping hammer assembly 26 and a control unit 28. Rapping hammer assembly 26 includes hammers 30 that are attached to a rotating shaft 32. Hammers 30 can be made of any material suitable to contact SCR protective device 20. Examples of such materials include, but are not limited to: metal, plastic, rubber, concrete, and any other suitable synthetic or naturally occurring material. The weight and size of hammers 30 will vary depending on the system, the amount of fly ash, and the size of SCR protective device 20. Hammers 30 can be replaced from time to time, or as necessary with hammers that weigh more or less than the typical hammers used in the system. Additionally, hammers 30 can be replaced with hammers that are larger or smaller than the typical hammers used in the system.

Hammers 30 contact SCR protective device 20 with a hitting, rapping, or striking motion of sufficient force to cause at least a portion of fly ash that has accumulated on the SCR protective device to slough off and be removed therefrom. It is contemplated that hammers 30 can contact any portion of SCR protective device 20, including any surrounding supporting frame.

Rotating shaft 32 is attached to hammers 30. Preferably, rotating shaft 32 is made of steel; however one skilled in the art will recognize that other materials, such as plastic, or other synthetic or naturally occurring material may be used for the rotating shaft.

Rotating shaft 32 is typically rotated by control unit 28 thereby causing hammers 30 to contact SCR protective device 20. Rapping hammer assembly 26 may be operated by an electric or battery operated motor located in control unit 28. Alternatively, rapping hammer assembly 26 could be operated by pneumatic cylinders or magnetic impulse devices, or by any other power source that would allow hammers 30 to contact SCR protective device 20 in a forceful motion to remove accumulated fly ash.

Typically, control unit 28 is connected to rapping hammer assembly 26 via rotating shaft 32. The motor, or other power means, actuates the movement of hammers 30.

In one embodiment of the present invention, control unit 28 includes a user interface 33 such as a desktop computer, a laptop computer, a monitor, or other display device that allows a user to vary the settings of rapper hammer assembly 26. User interface 33 would allow the user to control several variables, including but not limited to, the pressure of hammers 30 striking SCR protective device 20, the amount of times the hammers strike the SCR protective device in a specific time period, and/or the continuity of the hammer strikes on the SCR protective device. These variables would vary and are specific to each plant. Control of these variables will facilitate the removal of at least a portion of any fly ash accumulated on SCR protective device 20.

In one embodiment of the invention, hammers 30 continuously strike SCR protective device 20. In another embodiment, hammers 30 strike SCR protective device 20 at predetermined times. In yet another embodiment, a sensor or measuring device 34, such as a differential pressure transmitter, may be employed to determine when a certain amount of fly ash accumulates on SCR protective device 20. Once a certain amount of fly ash accumulates on SCR protective device 20, hammers 30 will be activated and will strike the SCR protective device.

As shown in FIG. 2, at least a portion of rapping hammer assembly 26 is within ductwork that has a flue gas stream flowing through it. Typically, in this embodiment control unit 28 is located outside flue duct wall 35. A wall seal 36 prevents the flue gas from escaping from flue duct wall 35.

Figure 3:
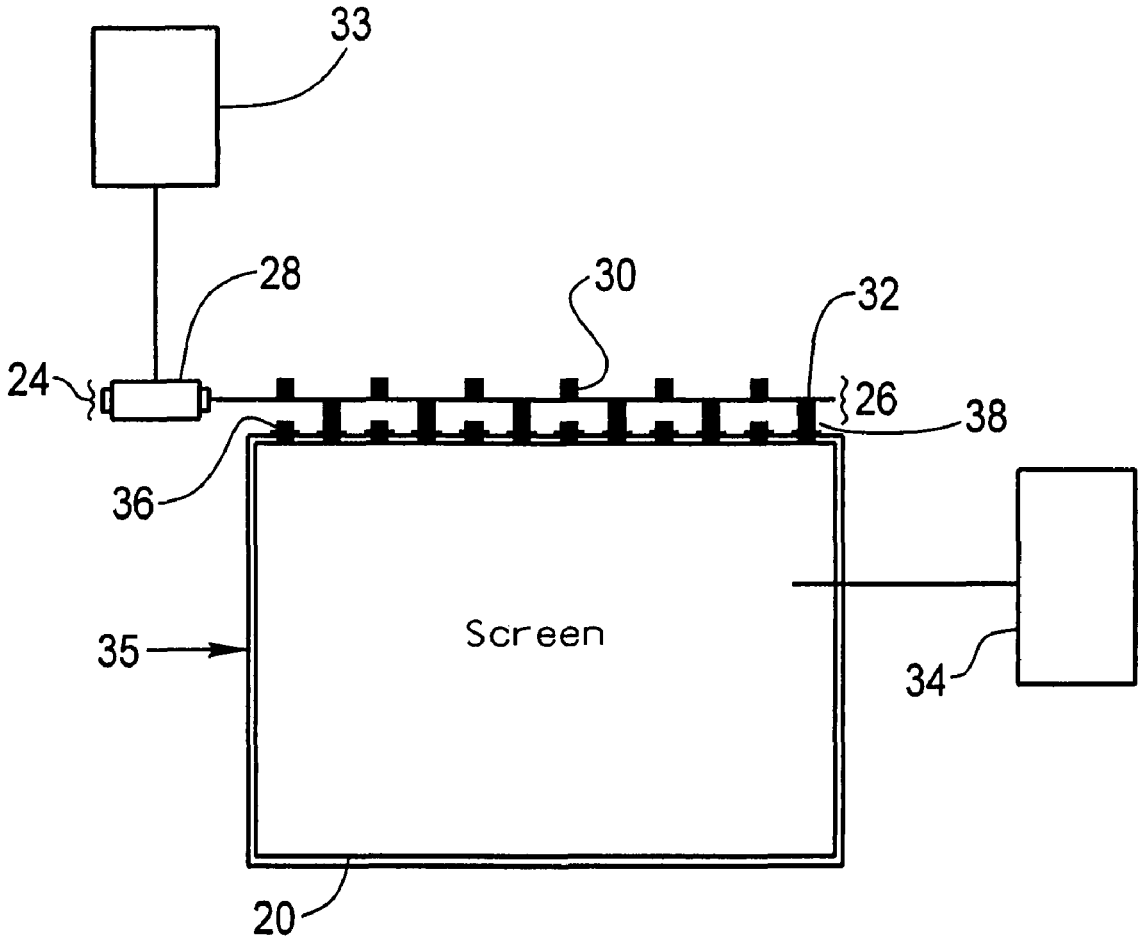
FIG. 3 shows a rapping hammer assembly outside of a flue gas stream.

In another embodiment, as shown in FIG. 3, SCR protective device 20 includes a plurality of contact elements 38 that protrude from the SCR protective device. Contact elements 38 also protrude at least partially outside flue duct wall 35. Contact elements 38 may be made of any material that is suitable to be contacted with hammers 30. Examples of appropriate materials include, but are not limited to, metal, plastic, rubber, concrete, and other synthetic or naturally occurring materials. Contact elements 38 provide a surface which hammers 30 can impact instead of hitting SCR protective device 20 directly.

Typically, rapping hammer assembly 26 is not directly connected to SCR protective device 20. As shown in FIG. 3, hammers 30 strike contact elements 38 which protrude outside flue duct wall 35. In this embodiment, rapping hammer assembly 26 is outside flue duct wall 35 and is not exposed to the flue gas.

Figure 4:
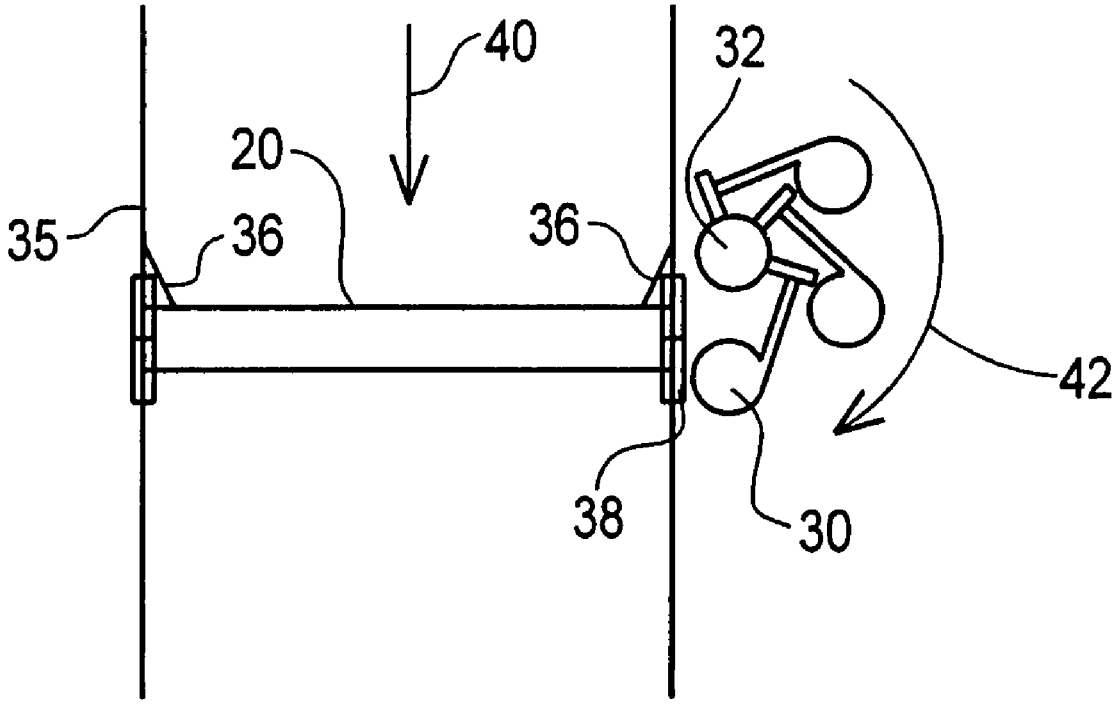
FIG. 4 shows a side view of the rapping hammer assembly.

FIG. 4 shows a side view of FIG. 3. As seen in this figure, the flow of the flue gas 40 travels towards and goes through SCR protective device 20. Fly ash and other particulates present in the flue gas are captured by SCR protective device 20. Hammers 30 move in a semi-circular direction 42 toward contact elements 38, connected to SCR protective device 20. Rotating shaft 32 rotates hammers 30 toward contact elements 38.

As one skilled in the art will recognize, there may be one or more mechanical rapping systems 24 attached to one SCR protective device 20. The number of hammers 30 per rapping hammer assembly 26 may vary to optimize the point(s) at which SCR protective device 20 is impacted by the hammers.

Additionally, one of ordinary skill in the art will recognize that one or more contact elements 38 may be connected to SCR protective device 20.

Once hammers 30 have struck SCR protective device 20 in an effective manner, very little fly ash will remain on the SCR protective device. However, it may be necessary to repeat the contact of hammers 30 to the SCR protective device 20 more than once. Therefore, rapping hammer assembly 26 may be programmed or monitored so hammers 30 strike contact elements 38 numerous times within a certain time period. Alternatively, rapping hammer assembly 26 may repeatedly contact SCR protective device 20 for continuous fly ash removal. In another alternative embodiment, sensor 34 may be used to measure or detect an amount of fly ash present on SCR protective device 20. Once the amount of fly ash reaches a certain level, rapping hammer assembly 26 can be activated, thereby causing hammers 30 to strike contact elements 38.

The manner in which hammers 30 contact SCR protective device 20 will vary from system to system. The action of hammers 30 contacting SCR protective device 20 will allow fly ash particles to slough off and continue through the system. Rapping hammer systems applied to SCR protective devices installed upstream of the catalyst bed dislodge fly ash particles back into the flue gas stream or move the fly ash along SCR protective device 20 to a discharge point. Alternatively, dislodging fly ash can be transported along SCR protective device 20 to an ash collection hopper (not shown).

While the invention is directed to the use of a mechanical rapping system on SCR protective devices, one skilled in the art will recognize that this mechanical rapping system can alternatively be employed on any item or device, including SCR protective devices that are designed to improve fly ash knockout in hoppers upstream of the SCR reactor. These items or devices include, but are not limited to economizer outlet "bull noses," kicker plates, splitters, and other similar items.

Figure 5:
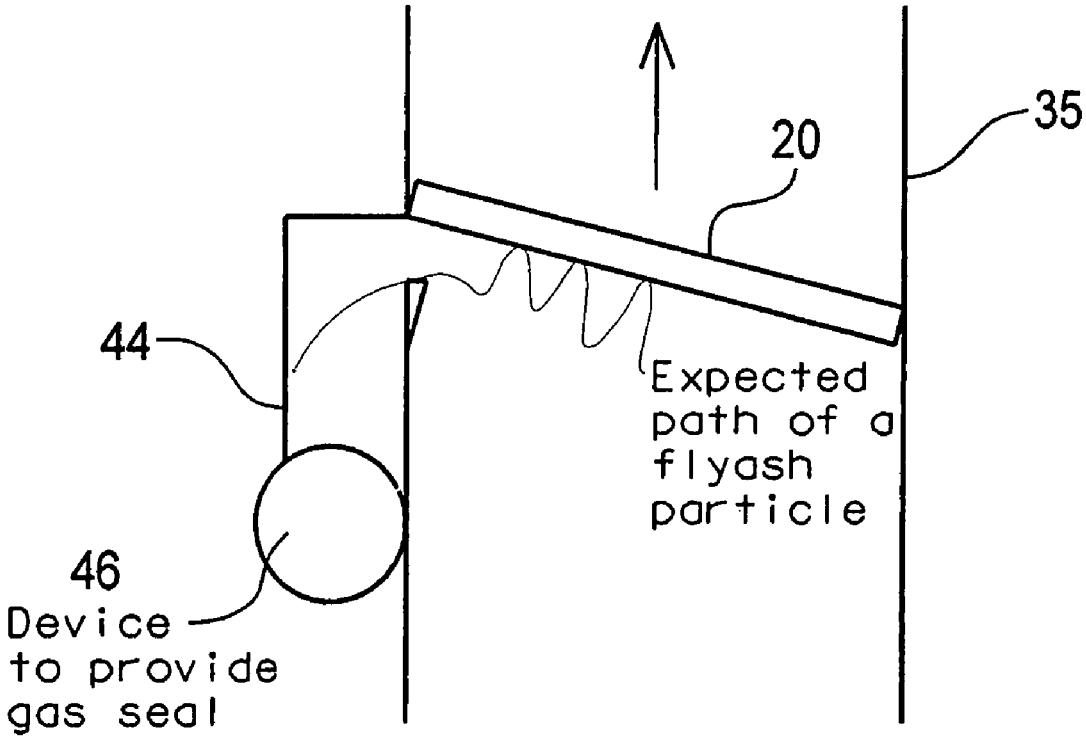
FIG. 5 shows a side view of a SCR protective device.

When a mechanical rapping system is used in connection with SCR protective devices upstream of the SCR reactor, the dislodged fly ash particles may be removed back into the flue gas stream or may be removed to a discharge point or fly ash collection hopper. FIG. 5 shows a side view of SCR protective device 20 and a path which a fly ash particle may take once it contacts the SCR protective device. After the fly ash particles are dislodged from SCR protective device 20, a portion of the particles may fall by gravity to an ash collection hopper installed below the screen. Some of the dislodged particles may be carried by the flue gas stream back to SCR protective device 20. When an SCR protective device 20 is installed on a slope, as shown in FIG. 5, the ash particles will eventually work their way to the edge of the SCR protective device where they can be dislodged into a discharge pipe 44, vacuumed out from time to time, or removed by a device that provides a gas seal 46, e.g. a cyclone or loop seal.

One or more embodiments of the present invention have been described. Nevertheless, it will be understood that various modifications may be made without departing from the spirit and scope of the invention.

What is claimed is:

1. A system for removing pollutants from a flue gas, the system comprising a selective catalytic reduction (SCR) system comprising:

a SCR reactor containing a $NO_x$ reducing catalyst;

one or more mesh screens located upstream of the SCR reactor wherein the one or more mesh screens substantially prevent fly ash particles in the flue gas from entering the SCR reactor or otherwise impeding the flow of flue gas therethrough;

a mechanical rapping system for impacting the one or more mesh screens to dislodge therefrom accumulated fly ash particles, said mechanical rapping system including a plurality of hammers and a rotating shaft, said plurality of hammers including top and bottom rows of hammers mounted offset from one another on top and bottom surfaces of said rotating shaft; and a control unit including a user interface for manually adjusting settings of the mechanical rapping system including adjusting at least of a striking pressure of the plurality of hammers against the one or more screens, an amount of times the plurality of hammers strike the one or more screens during a specific time period, and a continuity of striking of the plurality of hammers against the one or more screens;

wherein said top and bottom rows of hammers are positioned on said rotating shaft so as to alternate impacting the one or more mesh screens when said rotating shaft is rotated.

2. A system according to claim 1, wherein said mechanical rapping system comprises:

a sensor joined with said one or more mesh screens for measuring an amount of fly ash on said one or more mesh screens; and wherein said control unit activates the plurality of hammers when said amount of fly ash on said one or more mesh screens as indicated by said sensor equals a predetermined amount.

3. A system according to claim 2, wherein the control unit comprises an electric motor.

4. A system according to claim 2, wherein the control unit comprises pneumatic pump cylinders.

5. A system according to claim 2, wherein the control unit comprises a magnetic impulse device.

6. A system according to claim 1, wherein said user interface comprises devices to control at least one variable selected from speed, pressure, time and continuity.

7. A system according to claim 1, wherein the mechanical rapping system is operatively connected to the one or more mesh screens within a ductwork.

8. A system according to claim 1, wherein the mechanical rapping system is connected to the one or more mesh screens outside a ductwork.

9. A system according to claim 8, wherein the hammers strike contact elements extending from the one or more mesh screens.

* * * * *